US011162501B1

(12) United States Patent
Dewitt et al.

(10) Patent No.: US 11,162,501 B1
(45) Date of Patent: Nov. 2, 2021

(54) PORTABLE CEILING FAN

(71) Applicants: Annie Dewitt, Charlotte, NC (US); Johnny White, Charlotte, NC (US)

(72) Inventors: Annie Dewitt, Charlotte, NC (US); Johnny White, Charlotte, NC (US)

( * ) Notice: Subject to any disclaimer, the term of this patent is extended or adjusted under 35 U.S.C. 154(b) by 189 days.

(21) Appl. No.: 16/579,950

(22) Filed: Sep. 24, 2019

(51) Int. Cl.
*F04D 25/08* (2006.01)
*F04D 29/64* (2006.01)
*F04D 25/06* (2006.01)

(52) U.S. Cl.
CPC ..... *F04D 25/088* (2013.01); *F04D 25/068* (2013.01); *F04D 25/0673* (2013.01); *F04D 29/646* (2013.01)

(58) Field of Classification Search
None
See application file for complete search history.

(56) References Cited

U.S. PATENT DOCUMENTS 5,567,117 A 10/1996 Gunn
5,845,886 A 12/1998 McCormick
6,015,274 A * 1/2000 Bias ..... F04D 25/088 417/423.1
6,095,767 A * 8/2000 Caughey ..... F04D 25/088 416/162
7,028,963 B1 * 4/2006 Silva ..... F04D 25/088 248/342
7,703,466 B1 4/2010 Smith
8,253,272 B2 * 8/2012 Schulzman ..... F04D 25/068 307/40
8,348,220 B2 1/2013 Carter
2008/0011928 A1 * 1/2008 Adrian ..... H02G 3/20 248/343
2015/0330410 A1 * 11/2015 Yao ..... F04D 29/644 417/424.1
2018/0038376 A1 2/2018 Swaney

* cited by examiner

*Primary Examiner* — Michael Lebentritt
*Assistant Examiner* — Jason G Davis

(57) ABSTRACT

The portable ceiling fan is a fan that removably attaches to a ceiling. The portable ceiling fan magnetically attaches to the ceiling. The portable ceiling fan is independently powered. By independently powered is meant that the portable ceiling fan can operate without a direct connection to an external power source. The portable ceiling fan comprises a ceiling fan, a mounting plate, and a control system. The mounting plate attaches to the ceiling with an adhesive. The mounting plate magnetically attaches to the ceiling fan such that the mounting plate attaches the ceiling fan to the ceiling. The control system remotely controls the ceiling fan such that the ceiling fan can be turned on and off without requiring physical access to the ceiling fan.

13 Claims, 5 Drawing Sheets

PORTABLE CEILING FAN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of mechanical and positive and non-positive displacement pumps for moving fluids, more specifically, a ceiling fan. (F04D25/088)

SUMMARY OF INVENTION

The portable ceiling fan is a fan that removably attaches to a ceiling. The portable ceiling fan magnetically attaches to the ceiling. The portable ceiling fan is independently powered. By independently powered is meant that the portable ceiling fan can operate without a direct connection to an external power source. The portable ceiling fan comprises a ceiling fan, a mounting plate, and a control system. The mounting plate attaches to the ceiling with an adhesive. The mounting plate magnetically attaches to the ceiling fan such that the mounting plate attaches the ceiling fan to the ceiling. The control system remotely controls the ceiling fan such that the ceiling fan can be turned on and off without requiring physical access to the ceiling fan.

These together with additional objects, features and advantages of the portable ceiling fan will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable ceiling fan in detail, it is to be understood that the portable ceiling fan is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable ceiling fan.

It is therefore important that the claims be regarded as including such equivalent construction insofar as they do not depart from the spirit and scope of the portable ceiling fan. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
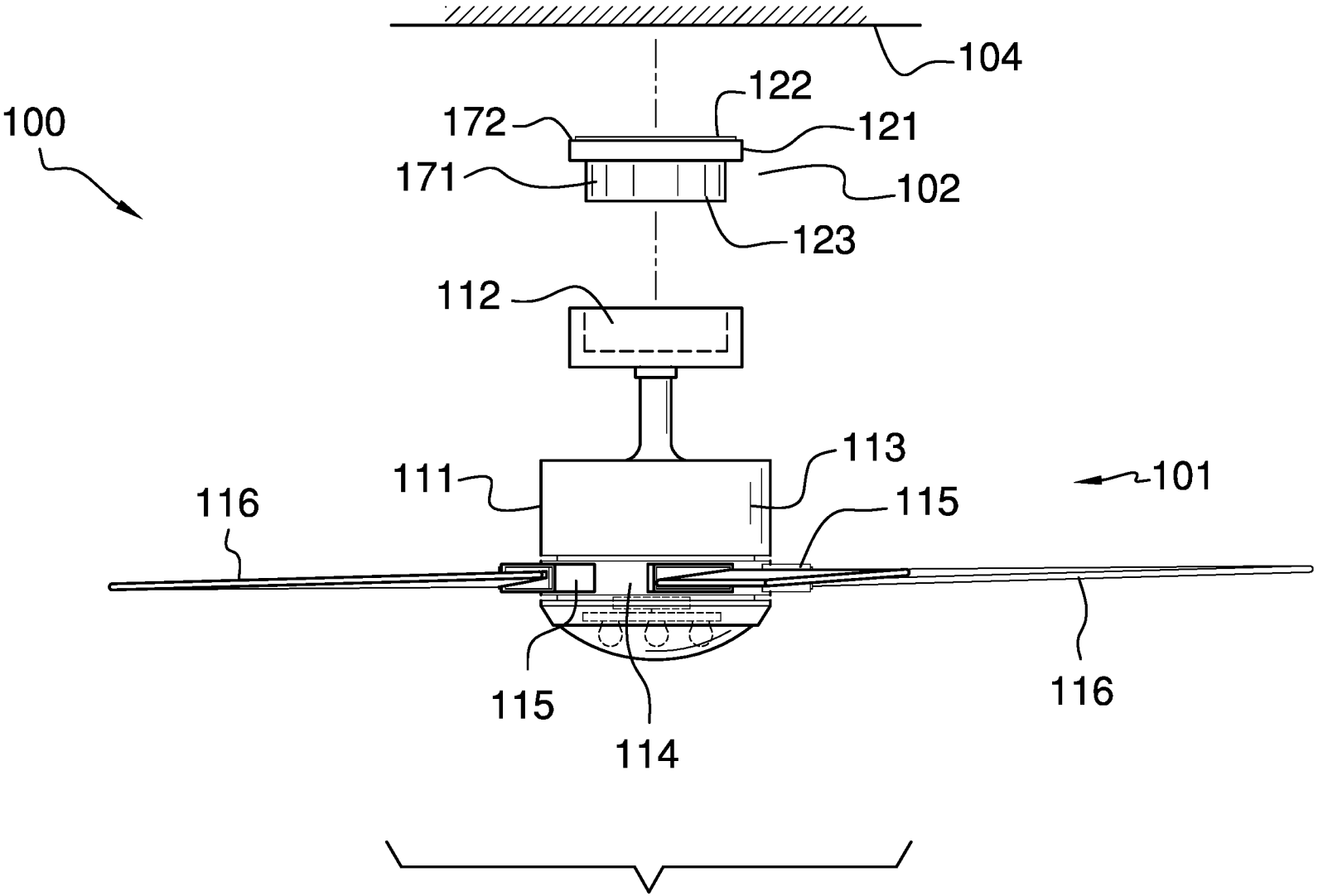
FIG. 1 is an exploded view of an embodiment of the disclosure.
Figure 2:
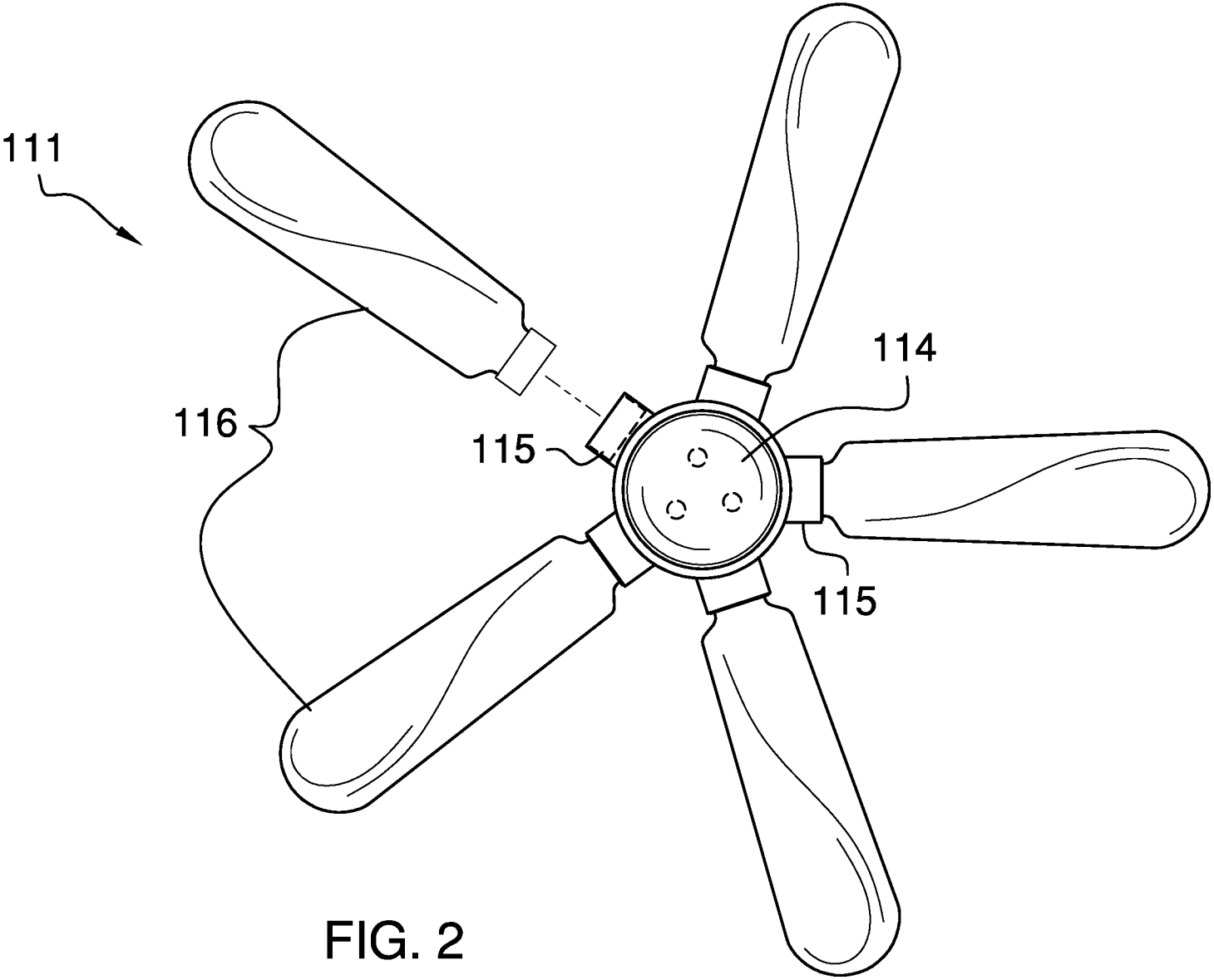
FIG. 2 is a bottom view of an embodiment of the disclosure.
Figure 3:
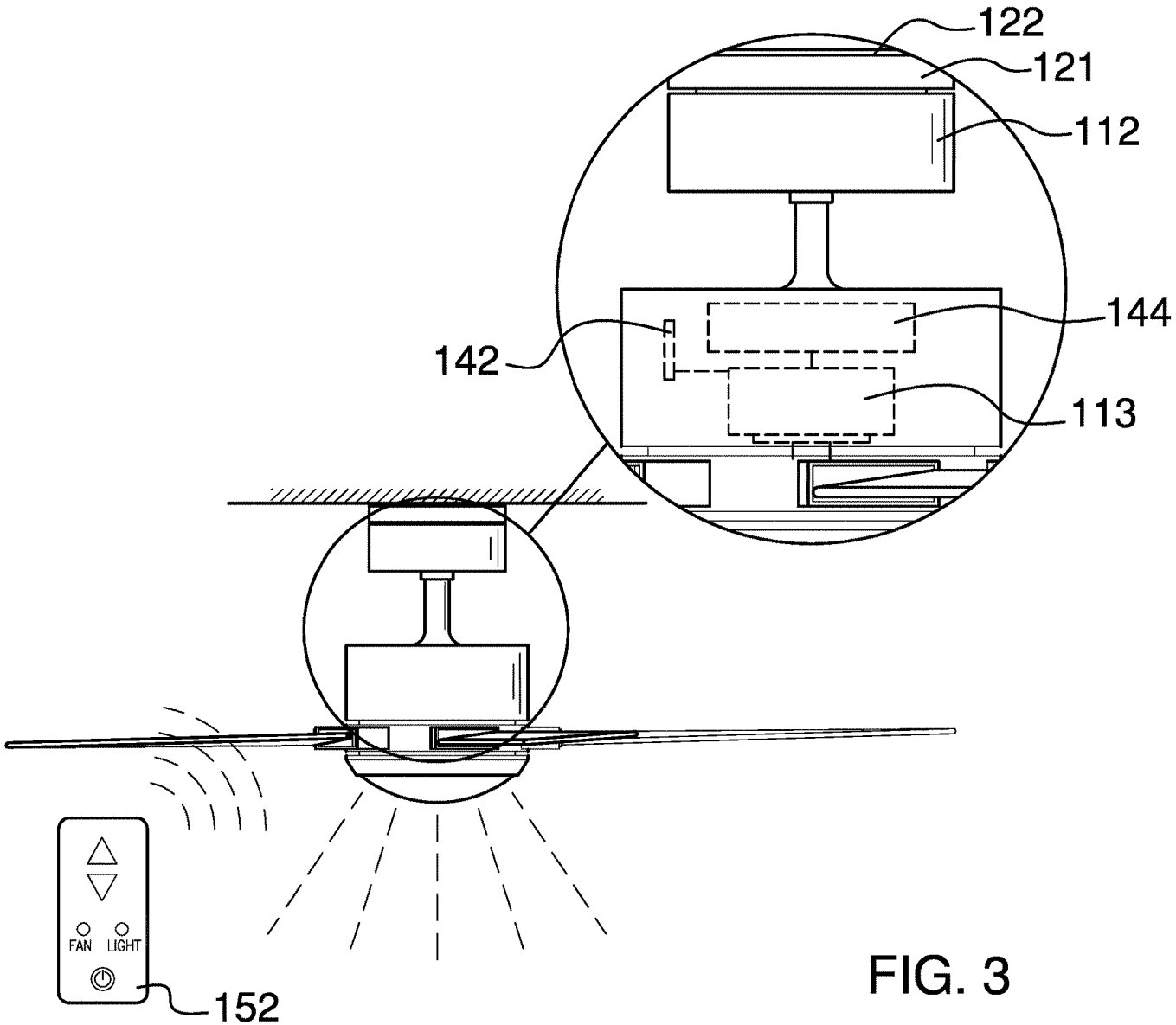
FIG. 3 is a detail view of an embodiment of the disclosure.
Figure 4:
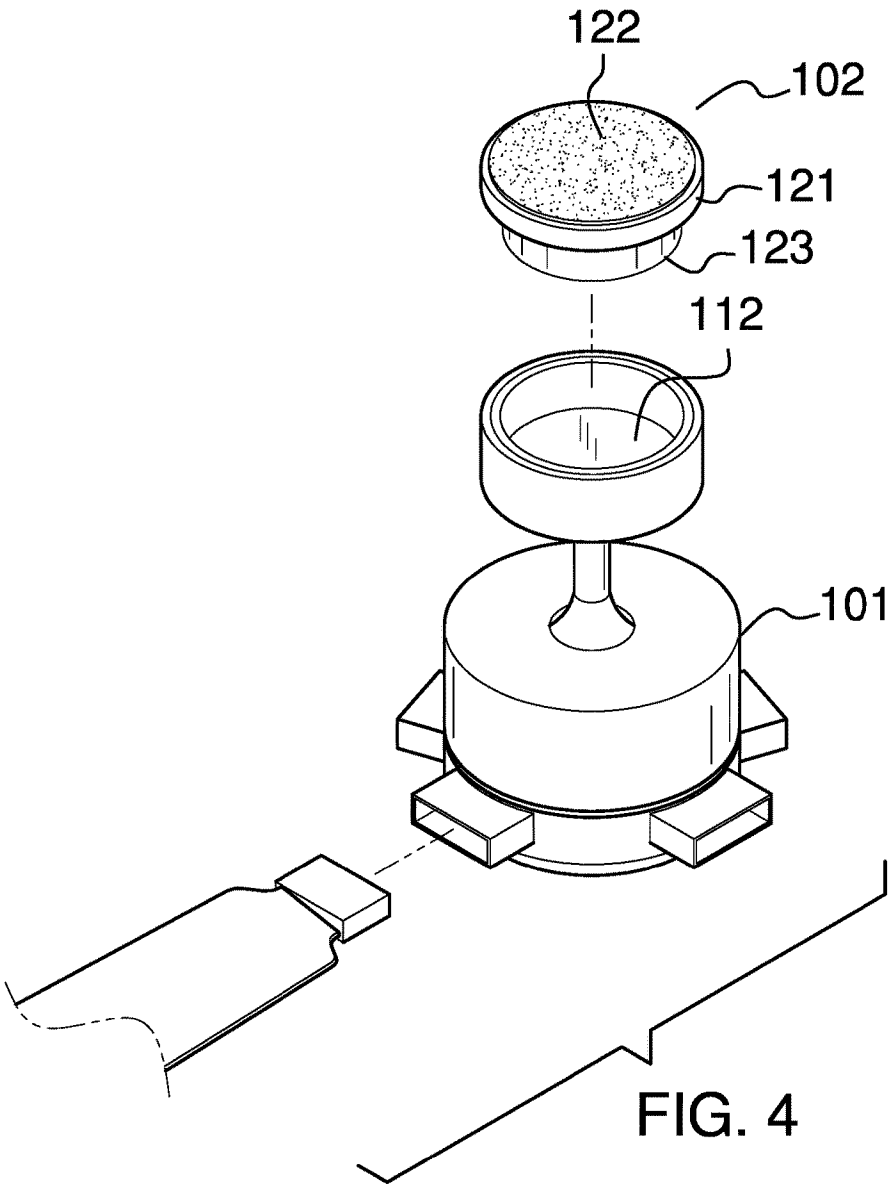
FIG. 4 is an exploded detail view of an embodiment of the disclosure.
Figure 5:
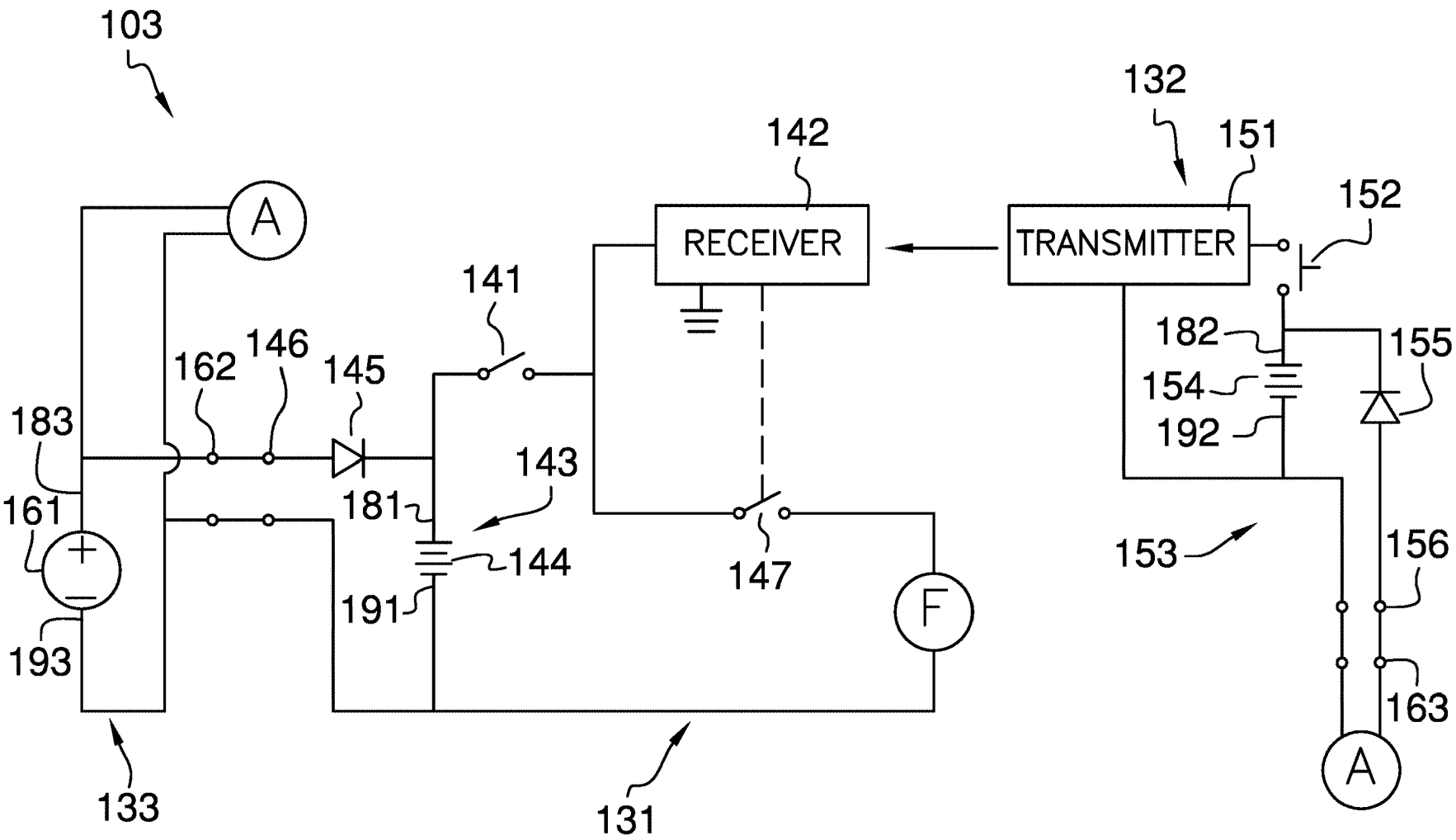
FIG. 5 is a schematic view of an embodiment of the disclosure.

Detailed reference will now be made to one or more potential embodiments of the disclosure, which are illustrated in FIGS. 1 through 5.

The portable ceiling fan 100 (hereinafter invention) is a fan that removably attaches to a ceiling 104. The invention 100 magnetically attaches to the ceiling 104. The invention 100 is independently powered. By independently powered is meant that the invention 100 can operate without a direct connection to an external electrical energy supply source. The invention 100 comprises a ceiling 104 fan 101, a mounting plate 102, and a control system 103. The mounting plate 102 attaches to the ceiling 104 with a removable adhesive 122. The mounting plate 102 magnetically attaches to the ceiling 104 fan 101 such that the mounting plate 102 attaches the ceiling 104 fan 101 to the ceiling 104. The control system 103 remotely controls the ceiling 104 fan 101 such that the ceiling 104 fan 101 can be turned on and off without requiring physical access to the ceiling 104 fan 101. The ceiling 104 is defined elsewhere in this disclosure.

The ceiling 104 fan 101 is a mechanical device known as a fan. The ceiling 104 is configured for use temporary use in a chamber. The ceiling 104 fan 101 is a bladed pump that generates an air flow in the chamber. The ceiling 104 fan 101 removably attaches to a ceiling 104. The ceiling 104 fan 101 magnetically attaches to the ceiling 104. The ceiling 104 fan 101 comprises a fan structure 111 and a first magnet 112.

The first magnet 112 is a mechanical structure. The first magnet 112 is a magnet that attaches to the fan structure 111. The first magnet 112 magnetically attaches to the mounting plate 102 such that the first magnet 112 attaches the fan structure 111 to the mounting plate 102.

The fan structure 111 is the mechanical structure of the ceiling 104 fan 101 that generates the air flow in the chamber. The fan structure 111 is a rotating structure. The fan structure 111 is a bladed structure. The fan structure 111 comprises a fan motor 113, a rotating disk 114, a plurality of blade mounts 115, and a plurality of fan blades 116.

The fan motor 113 is an electric motor. The fan motor 113 draws electrical energy from the control system 103. The fan motor 113 converts electrical energy into rotational energy used to rotate the plurality of fan blades 116 which in turn generates the air flow in the chamber. The control system 103 controls the operation of the invention 100 by controlling the flow of electricity into fan motor 113.

The rotating disk 114 is a disk-shaped structure. The face of the rotating disk 114 attaches to the rotor of the fan motor 113 such that the rotation of the fan motor 113 rotates the rotating disk 114. The rotating disk 114 attaches to the rotor of the fan motor 113. The center axis of the rotating disk 114 aligns with the center of rotation of the rotor of the fan motor 113 such that the rotating disk 114 rotates in alignment with the fan motor 113.

Each of the plurality of blade mounts 115 is a fastening device. Each of the plurality of blade mounts 115 attaches to the face of the rotating disk 114 that is distal from the face of the rotating disk 114 that attaches to the rotor of the fan motor 113. The plurality of blade mounts 115 removably attaches a blade selected from the plurality of fan blades 116 to the rotating disk 114 such that the selected blade projects radially away from the center of rotation of the rotor of the fan motor 113.

Each of the plurality of fan blades 116 is a blade that generates a movement of air as the plurality of blade mounts 115 moves through the air. Each of the plurality of fan blades 116 attach to a blade mount selected from the plurality of blade mounts 115 such that the rotation of the rotating disk 114 rotates the plurality of fan blades 116. The rotation of the plurality of fan blades 116 generates the air flow in the chamber.

The mounting plate 102 is a mechanical structure. The mounting plate 102 attaches to the ceiling 104. The ceiling 104 fan 101 magnetically attaches to the mounting plate 102 such that the mounting plate 102 suspends the ceiling 104 fan 101 from the ceiling 104. The mounting plate 102 comprises a mounting disk 121, an adhesive 122, and a second magnet 123. The mounting disk 121 is further defined with a first face 171 and a second face 172.

The mounting disk 121 is a disk-shaped structure. The mounting disk 121 forms a pedestal that transfers the load of the ceiling 104 fan 101 to the ceiling 104. The adhesive 122 is a chemical compound that is applied to the second face 172 of the mounting disk 121. The adhesive 122 attaches the mounting disk 121 to the ceiling 104. The second magnet 123 is a magnet. The second magnet 123 permanently attaches to the first face 171 of the mounting disk 121. The position of the second magnet 123 on the mounting disk 121 is oriented such that the second magnet 123 attracts and attaches to the first magnet 112 to magnetically attach the ceiling 104 fan 101 to the mounting plate 102.

The control system 103 comprises a plurality of electric circuits. The control system 103 controls the operation of the ceiling 104 fan 101. The control system 103 controls the flow of electrical energy into the ceiling 104 fan 101. The control system 103 is an electrochemical device such that the control system 103 converts chemical potential energy into electrical energy used to power the operation of the ceiling 104 fan 101. The control system 103 is a remotely controlled device. By remote controlled is meant that the control system 103 controls the flow of electricity through the ceiling 104 fan 101 without requiring direct access to the ceiling 104 fan 101. The control system 103 comprises a fan control circuit 131, an operating circuit 132, and a power circuit 133. The power circuit 133 forms an electrical connection with the fan control circuit 131. The power circuit 133 forms an electrical connection with the operating circuit 132.

The power circuit 133 is an electrical circuit. The power circuit 133 electrically connects to the fan control circuit 131. The power circuit 133 electrically connects to the operating circuit 132. The power circuit 133 provides the fan control circuit 131 with the energy necessary to generate the chemical potential energy stored within the fan control circuit 131. The power circuit 133 provides the operating circuit 132 with the energy necessary to generate the chemical potential energy stored within the operating circuit 132. The power circuit 133 comprises an external power source 161. The external power source 161 is further defined with a second positive terminal 183 and a third negative terminal 193. The external power source 161 further comprises a first charging plug 162 and a second charging plug 163. The external power source 161, the first charging plug 162 and the second charging plug 163 are electrically interconnected.

The fan control circuit 131 is an electric circuit. The fan control circuit 131 controls the operation of the ceiling 104 fan 101. Specifically, the fan control circuit 131 physically controls the flow of electrical energy into the fan motor 113. The fan control circuit 131 is an electrochemical device that is capable of generating electrical energy without an electrical connection to the external power source 161 of the power circuit 133. The fan control circuit 131 comprises a master switch 141, a receiver 142, and a first battery 144 circuit 143. The master switch 141, the receiver 142, and the first battery 144 circuit 143 are electrically interconnected.

The master switch 141 is a maintained electrical switch. The master switch 141 electrically connects in series between the first battery 144 circuit 143 and the receiver 142. The master switch 141 enables the operation of the receiver 142 and effectively operates as the power switch of the fan control circuit 131.

The receiver 142 is a radio frequency receiver 142. The receiver 142 is defined elsewhere in this disclosure. The receiver 142 receives operating instructions transmitted to the receiver 142 by the operating circuit 132. The receiver 142 opens and closes the controlled switch 147 in response to the operating instructions received from the operating circuit 132. The receiver 142 further comprises a controlled switch 147. The controlled switch 147 is an electrical switch. The controlled switch 147 electrically connects in series between the master switch 141 and the fan motor 113 of the ceiling 104 fan 101. The controlled switch 147 controls the operation of the ceiling 104 fan 101 by controlling the flow of electricity into ceiling 104 fan 101 from the first battery 144 of the first battery 144 circuit 143. The receiver 142 controls the operation of the controlled switch 147.

The first battery 144 circuit 143 is an electrical circuit. The first battery 144 circuit 143 is an electrochemical device. The first battery 144 circuit 143 stores chemical potential energy and converts the chemical potential energy into the electrical energy required to power the operation of the ceiling 104 fan 101 and the fan control circuit 131. The first battery 144 circuit 143 comprises a first battery 144, a first diode 145, and a first charging port 146. The first battery 144 is further defined with a first positive terminal 181 and a first negative terminal 191. The first battery 144, the first diode 145, and the first charging port 146 are electrically interconnected.

The first battery 144 is a commercially available rechargeable first battery 144. The chemical energy stored within the rechargeable first battery 144 is renewed and restored through the use of the first charging port 146. The first charging port 146 is an electrical circuit that reverses the polarity of the rechargeable first battery 144 and provides the energy necessary to reverse the chemical processes that the rechargeable first battery 144 initially used to generate the electrical energy. This reversal of the chemical process creates a chemical potential energy that will later be used by the rechargeable first battery 144 to generate electricity.

The first charging port 146 forms an electrical connection to an external power source 161 using a first charging plug 162. The first charging plug 162 forms a detachable electrical connection with the first charging port 146. The first charging port 146 receives electrical energy from the external power source 161 through the first charging plug 162. The first diode 145 is an electrical device that allows current to flow in only one direction. The first diode 145 installs between the rechargeable first battery 144 and the first charging port 146 such that electricity will not flow from the first positive terminal 181 of the rechargeable first battery 144 into the third positive terminal 183 of the external power source 161.

The operating circuit 132 is an electrical circuit. The operating circuit 132 remotely controls the operation of the fan control circuit 131. The operating circuit 132 transmits control signals to the fan control circuit 131 using a radio frequency communication link. The operating circuit 132 allows for the operation of the ceiling 104 fan 101 without physical access to the ceiling 104 fan 101. The operating circuit 132 is an electrochemical device that is capable of generating electrical energy without an electrical connection to the external power source 161 of the power circuit 133. The operating circuit 132 comprises a transmitter 151, an initiation switch 152, and a second battery 154 circuit 153. The transmitter 151, the initiation switch 152, and the second battery 154 circuit 153 are electrically interconnected.

The transmitter 151 is a radio frequency transmitter 151. The transmitter 151 is defined elsewhere in this disclosure. The transmitter 151 transmits operating instructions to the receiver 142 of the fan control circuit 131. The transmitter 151 remotely controls the operation of the fan control circuit 131 through its control of the receiver 142 of the fan control circuit 131. The initiation switch 152 is an electrical switch. The initiation switch 152 controls the operation of the transmitter 151. The transmitter 151 sends an operating signal to the receiver 142 of the fan control circuit 131 when the initiation switch 152 is actuated. The initiation switch 152 effectively turns the ceiling 104 fan 101 on and off.

In the first potential embodiment of the disclosure, the transmitter 151, the receiver 142, including the controlled switch 147, and the initiation switch 152 including the initiation switch 152 are provisioned as a commercially available 433 MHz remote control switch and transmitter kit.

The second battery 154 circuit 153 is an electrical circuit. The second battery 154 circuit 153 is an electrochemical device. The second battery 154 circuit 153 stores chemical potential energy and converts the chemical potential energy into the electrical energy required to power the operation of the operating circuit 132. The second battery 154 circuit 153 comprises a second battery 154, a second diode 155, and a second charging port 156. The second battery 154 is further defined with a second positive terminal 182 and a second negative terminal 192. The second battery 154, the second diode 155, and the second charging port 156 are electrically interconnected.

The second battery 154 is a commercially available rechargeable first battery 144. The chemical energy stored within the rechargeable second battery 154 is renewed and restored through the use of the second charging port 156. The second charging port 156 is an electrical circuit that reverses the polarity of the rechargeable second battery 154 and provides the energy necessary to reverse the chemical processes that the rechargeable second battery 154 initially used to generate the electrical energy. This reversal of the chemical process creates a chemical potential energy that will later be used by the rechargeable second battery 154 to generate electricity.

The second charging port 156 forms an electrical connection to an external power source 161 using a second charging plug 163. The second charging plug 163 forms a detachable electrical connection with the second charging port 156. The second charging port 156 receives electrical energy from the external power source 161 through the second charging plug 163. The second diode 155 is an electrical device that allows current to flow in only one direction. The second diode 155 installs between the rechargeable second battery 154 and the second charging port 156 such that electricity will not flow from the second positive terminal 182 of the rechargeable second battery 154 into the third positive terminal 183 of the external power source 161.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Battery: As used in this disclosure, a battery is a chemical device consisting of one or more cells, in which chemical energy is converted into electricity and used as a source of power. Batteries are commonly defined with a positive terminal and a negative terminal.

Blade: As used in this disclosure, a blade is a term that is used to describe a wide and flat structure or portion of a larger structure such as a propeller.

Cavity: As used in this disclosure, a cavity is an empty space or negative space that is formed within an object.

Ceiling: As used in this disclosure a ceiling refers to either: 1) the superior horizontal surface of a chamber that is distal from the floor; 2) the superior horizontal surface of a structure; or, 3) the upper limit of a range. A floor and a ceiling can refer to the same structure wherein the selection depends solely on the point of view of the user. The selection of this definition depends on the context. In situations where the context is unclear the first definition should be used.

Chamber: As used in this disclosure, a chamber is an enclosed space within a building.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electric Current: As used in this disclosure, an electric current refers to the net movement of electrons past a point in an electric circuit: Electric current is often referred to a current. Electric current is measured in Amperes (Amps) and has the units of coulombs per second.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically cause the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

External Power Source: As used in this disclosure, an external power source is a source of the energy that is externally provided to enable the operation of the present disclosure. Examples of external power sources include, but are not limited to, electrical power sources and compressed air sources.

Fan: As used in this disclosure, a fan is a pump that moves a gas. The first potential embodiment of this disclosure assumes that the fan is a mechanical device with rotating blades that is used to create a flow or current of a gas.

Magnet: As used in this disclosure, a magnet is an ore, alloy, or other material that has its component atoms arranged so the material exhibits properties of magnetism such as: 1) attracting other iron-containing objects; 2) attracting other magnets; or, 3) or aligning itself in an external magnetic field.

Maintained Switch: A used in this disclosure, a maintained switch is a switch that maintains the position that was set in the most recent switch actuation. A maintained switch works in an opposite manner to a momentary switch.

Momentary Switch: As used in this disclosure, a momentary switch is a biased switch in the sense that the momentary switch has a baseline position that only changes when the momentary switch is actuated (for example when a pushbutton switch is pushed or a relay coil is energized). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Motor: As used in this disclosure, a motor refers to the method of transferring energy from an external power source into rotational mechanical energy.

Negative Space: As used in this disclosure, negative space is a method of defining an object through the use of open or empty space as the definition of the object itself, or, through the use of open or empty space to describe the boundaries of an object.

Pedestal: As used in this disclosure, a pedestal is an intermediary load bearing structure that that transfers a load between a between two objects or structures.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Radial: As used in this disclosure, the term radial refers to a direction that: 1) is perpendicular to an identified central axis; or, 2) projects away from a center point.

Receiver: As used in this disclosure, a receiver is a device that is used to receive and demodulate electromagnetic radiation such as radio signals.

Remote Control: As used in this disclosure, remote control means the establishment of control of a device from a distance. Remote control is generally accomplished through the use of an electrical device that generates electrically based control signals that are transmitted via radio frequencies or other means to the device.

Removable Adhesive: As used in this disclosure, a removable adhesive is a commercially available adhesive that is designed with a lower tack, or stickiness, such that a first object is attached to a second object with a removable adhesive the first object can be readily removed in a manner that ideally, though not necessarily practically, leaves behind no adhesive residue on the second object. A repositionable adhesive is a subset of removable adhesives that are intended to allow the first object to be reattached to a third object or the second object in the initial or a different position. Within this disclosure, a removable adhesive is assumed to include repositionable adhesives.

Rotation: As used in this disclosure, rotation refers to the cyclic movement of an object around a fixed point or fixed axis. The verb of rotation is to rotate.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Transceiver: As used in this disclosure, a transceiver is a device that is used to generate, transmit, and receive electromagnetic radiation such as radio signals.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A portable cooling fan comprising a ceiling fan, a mounting plate, and a control system;

wherein the mounting plate attaches to a ceiling with a removable adhesive;

wherein the control system remotely controls the ceiling fan such that the ceiling fan can be turned on and off without requiring physical access to the ceiling fan;

wherein the portable cooling fan removably attaches to the ceiling;

wherein the portable cooling fan magnetically attaches to the ceiling;

wherein the portable cooling fan is independently powered;

wherein by independently powered is meant that the portable cooling fan can operate without a direct connection to an external electrical energy supply source;

wherein the mounting plate magnetically attaches to the ceiling fan such that the mounting plate attaches the ceiling fan to the ceiling;

wherein the ceiling is configured for use temporary use in a chamber;

wherein the ceiling fan is a bladed pump that generates an air flow in the chamber;

wherein the ceiling fan removably attaches to the ceiling;

wherein the ceiling fan magnetically attaches to the mounting plate such that the mounting plate suspends the ceiling fan from the ceiling;

wherein the control system comprises a plurality of electric circuits;

wherein the control system controls the operation of the ceiling fan;

wherein the control system controls the flow of electrical energy into the ceiling fan;

wherein the control system is an electrochemical device such that the control system converts chemical potential energy into electrical energy used to power the operation of the ceiling fan;

wherein the control system is a remotely controlled device;

wherein by remote controlled is meant that the control system controls the flow of electricity through the ceiling fan without requiring direct access to the ceiling fan;

wherein the ceiling fan comprises a fan structure and a first magnet;

wherein the first magnet is a magnet that attaches to the fan structure;

wherein the first magnet magnetically attaches to the mounting plate such that the first magnet attaches the fan structure to the mounting plate;

wherein the fan structure is the mechanical structure of the ceiling fan that generates the air flow in the chamber;

wherein the fan structure is a rotating bladed structure.

2. The portable cooling fan according to claim 1 wherein the mounting plate comprises a mounting disk, and a second magnet;

wherein the mounting disk is further defined with a first face and a second face;

wherein the mounting disk is a disk-shaped structure;

wherein the mounting disk forms a pedestal that transfers the load of the ceiling fan to the ceiling;

wherein the second magnet is a magnet;

wherein the second magnet permanently attaches to the first face of the mounting disk.

3. The portable cooling fan according to claim 2 wherein the control system comprises a fan control circuit, an operating circuit, and a power circuit;

wherein the power circuit forms an electrical connection with the fan control circuit;

wherein the power circuit forms an electrical connection with the operating circuit;

wherein the power circuit is an electrical circuit;

wherein the power circuit provides the fan control circuit with the energy necessary to generate the chemical potential energy stored within the fan control circuit;

wherein the power circuit provides the operating circuit with the energy necessary to generate the chemical potential energy stored within the operating circuit;

wherein the fan control circuit is an electric circuit;

wherein the fan control circuit controls the operation of the ceiling fan;

wherein the operating circuit is an electrical circuit;

wherein the operating circuit remotely controls the operation of the fan control circuit;

wherein the operating circuit transmits control signals to the fan control circuit using a radio frequency communication link.

4. The portable cooling fan according to claim 3 wherein the fan structure comprises a fan motor, a rotating disk, a plurality of blade mounts, and a plurality of fan blades;

wherein the fan motor is an electric motor;

wherein the rotating disk is a disk-shaped structure;

wherein each of the plurality of blade mounts is a fastening device;

wherein each of the plurality of fan blades is a blade that generates a movement of air as the plurality of blade mounts moves through the air.

5. The portable cooling fan according to claim 4 wherein the fan motor draws electrical energy from the control system;

wherein the fan motor converts electrical energy into rotational energy used to rotate the plurality of fan blades which in turn generates the air flow in the chamber;

wherein the control system controls the operation of the portable cooling fan by controlling the flow of electricity into the fan motor.

6. The portable cooling fan according to claim 5 wherein a face of the rotating disk attaches to a rotor of the fan motor such that the rotation of the fan motor rotates the rotating disk;

wherein the rotating disk attaches to the rotor of the fan motor;

wherein the center axis of the rotating disk aligns with the center of rotation of the rotor of the fan motor such that the rotating disk rotates in alignment with the fan motor.

7. The portable cooling fan according to claim 6 wherein each of the plurality of blade mounts attaches to the face of the rotating disk that is distal from the rotor of the fan motor.

8. The portable cooling fan according to claim 7 wherein the plurality of blade mounts removably attaches a blade selected from the plurality of fan blades to the rotating disk such that the selected blade projects radially away from the center of rotation of the rotor of the fan motor;

wherein each of the plurality of fan blades attach to a blade mount selected from the plurality of blade mounts such that the rotation of the rotating disk rotates the plurality of fan blades;

wherein the rotation of the plurality of fan blades generates the air flow in the chamber.

9. The portable cooling fan according to claim 8 wherein the position of the second magnet on the mounting disk is oriented such that the second magnet attracts and attaches to the first magnet to magnetically attach the ceiling fan to the mounting plate.

10. The portable cooling fan according to claim 9 wherein the power circuit comprises an external power source;

wherein the external power source is further defined with a second positive terminal and a third negative terminal;

wherein the external power source further comprises a first charging plug and a second charging plug;

wherein the external power source, the first charging plug, and the second charging plug are electrically interconnected.

11. The portable cooling fan according to claim 10 wherein the fan control circuit is an electrochemical device that is capable of generating electrical energy without an electrical connection to the external power source of the power circuit;

wherein the fan control circuit physically controls the flow of electrical energy into the fan motor;

wherein the fan control circuit comprises a master switch, a receiver, and a first battery circuit;

wherein the master switch, the receiver, and the first battery circuit are electrically interconnected.

12. The portable cooling fan according to claim 11 wherein the master switch is a maintained electrical switch;

wherein the master switch electrically connects in series between the first battery circuit and the receiver;

wherein the master switch enables the operation of the receiver and effectively operates as the power switch of the fan control circuit;

wherein the receiver is a radio frequency receiver;

wherein the receiver further comprises a controlled switch;

wherein the receiver receives operating instructions transmitted to the receiver by the operating circuit;

wherein the receiver controls the operation of the controlled switch;

wherein the receiver opens and closes the controlled switch in response to the operating instructions received from the operating circuit;

wherein the controlled switch is an electrical switch;

wherein the controlled switch electrically connects in series between the master switch and the fan motor of the ceiling fan;

wherein the controlled switch controls the operation of the ceiling fan by controlling the flow of electricity into ceiling fan from the first battery of the first battery circuit;

wherein the first battery circuit is an electrical circuit;

wherein the first battery circuit is an electrochemical device.

13. The portable cooling fan according to claim 12 wherein the operating circuit is an electrochemical device that is capable of generating electrical energy without an electrical connection to the external power source of the power circuit;

wherein the operating circuit allows for the operation of the ceiling fan without physical access to the ceiling fan;

wherein the operating circuit comprises a transmitter, an initiation switch, and a second battery circuit;

wherein the transmitter, the initiation switch, and the second battery circuit are electrically interconnected;

wherein the transmitter is a radio frequency transmitter;

wherein the transmitter transmits operating instructions to the receiver of the fan control circuit;

wherein the transmitter remotely controls the operation of the fan control circuit through its control of the receiver of the fan control circuit;

wherein the initiation switch is an electrical switch;

wherein the initiation switch controls the operation of the transmitter;

wherein the transmitter sends an operating signal to the receiver of the fan control circuit when the initiation switch is actuated;

wherein the second battery circuit is an electrical circuit;

wherein the second battery circuit is an electrochemical device.

* * * * *